US005634289A

United States Patent [19]

Wascher

[11] Patent Number: 5,634,289

[45] Date of Patent: Jun. 3, 1997

[54] RECOIL PAD WITH SLING ATTACHMENT

[76] Inventor: Rick R. Wascher, Rte. 1, Box 415-B, Rock Island, Tenn. 38581

[21] Appl. No.: 452,299

[22] Filed: May 26, 1995

[51] Int. Cl.[6] ..... F41C 23/00

[52] U.S. Cl. ..... 42/74; 42/71.01; 42/73; 42/72; 42/71.02; 42/104

[58] Field of Search ..... 42/74, 71.01, 73, 42/72, 71.02, 104

[56] References Cited

U.S. PATENT DOCUMENTS

| | | | |
|---|---|---|---|
| 544,269 | 8/1895 | Winters | 42/74 |
| 779,461 | 1/1905 | Benton | 42/74 |
| 1,839,856 | 1/1932 | Anderson | 42/74 |
| 1,842,527 | 1/1932 | Knight | 42/74 |
| 2,468,349 | 4/1949 | Stewart | 42/74 |
| 2,885,812 | 5/1959 | Arpin | 42/74 |
| 3,696,544 | 10/1972 | Webb | 42/74 |
| 4,043,066 | 8/1977 | Pachmayr et al. | 42/71 P |
| 4,127,953 | 12/1978 | McBride | 42/1 W |
| 4,601,123 | 7/1986 | Swearengen et al. | 42/72 |
| 4,654,993 | 4/1987 | Atchisson | 42/71.01 |
| 5,134,797 | 8/1992 | Turner | 42/85 |
| 5,265,366 | 11/1993 | Thompson | 42/74 |
| 5,325,618 | 7/1994 | Turner | 42/85 |
| 5,410,833 | 5/1995 | Paterson | 42/73 |
| 5,471,776 | 12/1995 | Chestnut et al. | 42/74 |

OTHER PUBLICATIONS

Uncle Mikes Recoil Pads Received Oct. 17, 1994.

*Primary Examiner*—Charles T. Jordan
*Assistant Examiner*—Meena Chelliah
*Attorney, Agent, or Firm*—Rick R. Wascher

[57] ABSTRACT

A slip on recoil pad having a sleeve portion and a cushion portion. The sleeve and cushion portions can be formed integral with one another or be separate components attached together. The sleeve component may be comprised of a neoprene or polypropylene rubber for providing enhanced cushioning, warmth, and durability, and may also include a rifle sling attachment stud, grommet. The rifle sling attachment stud preferably includes a reinforcing liner or strip to prevent the reinforcing stud from pulling through the sleeve portion of the recoil pad. In addition, a protective layer is provided to overlie the rivet, or grommet portion attached to the eyelet of the rifle sling attachment stud to prevent marring or scratching of the rifle stock when it is installed and attached thereto.

20 Claims, 2 Drawing Sheets

RECOIL PAD WITH SLING ATTACHMENT

BACKGROUND OF THE INVENTION

1. Field of the Invention

The present invention relates generally to recoil pads and sling attachment studs for firearms such as rifles and shotguns, but more particularly to slip on recoil pads and sling attachment studs for firearms.

2. Description of the Related Art

The art to which the invention relates partially comprises recoil pads and the hardware for attaching a rifle sling to a rifle. Many commercially available firearms are sold having the rifle sling attachment studs mounted to the forend and butt stock portion of the firearm. Still others are sold with a forend cap and a smooth butt stock without having sling attachment stud. Firearms that do not provide a means for attaching a sling are often difficult to carry or climb elevated hunting stands in the deep woods. In such situations, the user must often lay the rifle on the ground while attaching a tether line, climb the stand and hoist the firearm up to a shooting position. Very often, the ground is wet, snow covered or muddy and, therefore, placing the firearm on the ground is not desired by the user.

Manufacturers of rifle slings have attempted to remedy this situation by producing what is commonly referred to as a "shotgun sling". The shotgun sling includes a pad having spaced apart looped ends with a sliding cinch. The looped ends are attached a length of strap. A user of such a sling typically slips the loop over the barrel of the rifle and the other loop over the butt stock of the firearm and cinches them tight. In this fashion, the firearm sling is attached to the firearm without the necessity of studs. A common drawback associated with these types of slings propensity to slide up and down the length of the firearm and therefore not maintain a uniform installed position. The slipping problem is further compounded when one considers the different configurations of butt stocks.

For example, in lever action rifles the butt stock may have a curved pistol grip portion or it may have a straight ranger style stock which is particularly well suited for scabbard carrying. Thus, if the user were to attach a shotgun sling to a pistol grip butt stock, the cinched end has a greater tendency to engage the pistol grip of the rifle stock and minimize slipping. However, with respect to the straight or ranger style stock, there is no stock structure on which the cinched loop can grip and therefore it slides freely along the length of the stock often into communication with the lever actuating mechanism of the rifle. If the loop and the rifle sling were to come into contact with the lever actuating mechanism, it could block the safe operation and manipulation of the lever rifle during shooting and hunting exercises.

Most firearms include sling attachment studs mounted to the stock portions of the firearm. A typical attachment stud includes a threaded shank which is turned into the stock material. The shank terminates in a button eyelet having a central bore for receiving the arm of a sling swivel or buckle.

Accordingly, when a firearm is not fitted with sling attachment studs at the factory, many shooters drill holes for insertion of sling attachment studs into the butt stock and sometimes into the forend stock. The disadvantages of drilling a firearm stock are most frequently attributable to improper or inaccurate drilling and installation of the stud. Of course, if the rifle stock is particularly ornate, includes aesthetically pleasing wood such as a deep walnut or redwood, or if the firearm has artistic or collectable value in "factory form", the user may not wish to drill holes in the stock for fear of altering its appearance or diminishing its value.

In addition, the art to which the invention relates is directed to recoil pads. On many rifles and shotguns, depending upon the design and manufacture, the recoil associated with firing the weapon is often unpleasant to the shooter. As a means to remedy this situation, various manufacturers have attached to the end of the butt stock a thickness of foam or elastomeric padding in an attempt to absorb the recoil associated with firing the weapon.

Many firearm manufacturers, however, do not include a recoil pad attached to the end of the stock. Many reasons may account for this, one of which is the added length, weight, or aesthetic appearance of the butt stock with the recoil pad attached. One common example is the lever action rifle where length is a consideration to some, but in comparison to the recoil felt by the shooter, many individuals desire a recoil pad attached to the end of the butt stock. Manufacturers have attempted to remedy this situation by providing slip on recoil pads. Some of the more popular recoil pads include a sleeve portion attached to a corrugated rubber portion. Still others replace the corrugated rubber portion with a gel-like package. The sleeve portion is slipped over the end of the butt stock and the corrugated portion is placed against the shooter's shoulder.

When the weapon is fired, the rearward recoil into the user's shoulder compresses the corrugated or gel portions thereby absorbing some of the felt recoil and shock. Such recoil pads can be placed on virtually any type stock, those that have rifle sling attachment studs, pistol grip type stocks or ranger style stocks without rifle sling attachments studs.

A common problem associated with slip on recoil pads, when applied to a firearm having rifle sling attachment studs, is the propensity of the sleeve portion to cover the stud attached to the butt stock. In this case the user must either trim the recoil pad or simply attach the sling buckle underneath the slip on pad which causes a bulge under the recoil pad and diminish the utility of the swivel action of the sling buckle to stud contact.

Accordingly, attachment of the slip on recoil pad to a butt stock of a firearm not having a butt stock rifle sling attachment stud does not alter the above described problem associated with the slippage of the aforedescribed shotgun slings.

Accordingly, it would be advantageous to invent a slip on recoil pad having a rifle sling attachment stud or other means of receiving an existing stud. Such a device would facilitate the absorption of recoil, eliminate the need for drilling holes into the wood of the butt stock, and eliminate the slippage associated with shotgun slings. Until now, it is believed that such a sling has not been invented.

SUMMARY OF THE INVENTION

The present invention is an improved slip on recoil pad having a corrugated portion, a sleeve extending from the corrugated portion, and an attachment stud mechanism. The preferred construction of the present invention can be of any suitable material such as rubber, flexible plastics, or virtually any suitable material capable of providing the structure necessary and associated with a recoil pad.

The present invention also includes a sling attachment stud or stud receiving mechanism (hereinafter an "attachment mechanism") attached to the slip on sleeve of the recoil pad. The attachment stud mechanism includes a typical sling eyelet through which a rifle sling swivel or buckle can be attached. The rifle sling swivel is attached to the sleeve of the recoil pad.

To prevent inadvertent extraction or the rifle sling eyelet from pulling through the sleeve material, a rivet, grommet, or stay can be attached to the post of the eyelet from the inside of the sleeve. In the preferred embodiment, the rivet, grommet, or stay is covered with a non-marring or non-scratching material. The non-marring or non-scratching material is provided so that when the recoil pad is slipped onto the stock of the rifle the wood stock is not scratched or marred by the rivet, grommet, stay or stud shank which is preferably made of a high strength metal construction.

In another preferred embodiment of the invention, the sling attachment stud has an eyelet and a post and the post extends through the sleeve portion of the recoil pad through a strip of non-metallic reinforcing material which partially or totally lies in the interior of the recoil pad so as to further prevent pulling or stretching of the recoil pad in an undesired fashion.

In the embodiment mentioned above, if the eyelet stud is capped with a rivet, grommet or stay on the inside of the sleeve portion of the recoil pad, the weight of the rifle may have a tendency to pull the recoil pad away from the rifle stock. As a means to remedy this situation, the reinforcing strip or liner that overlies the interior surface of the slip on recoil pad is firmly attached to that interior surface by adhesive, stitching, or any other suitable means of rigid attachment and is placed atop this reinforcing material. If a stay is used, the stay may have a curved construction such that a portion of the stay is parallel to the long axis of the firearm and a portion is perpendicular. In this way the stay may rest adjacent the butt stock end and bottom side. The force from the sling attached to the mechanism on the sleeve is then transferred to the end of the firearm via the stay.

Any pulling or forces applied to the attachment stud would have a tendency to distribute those forces over the liner or reinforcing strip on the interior of the recoil pad. Once again, in the preferred embodiment a layer of material is placed on top of the grommet or rivet to prevent scratching of the wood butt stock.

Accordingly, the present invention can be summarized in a variety of ways, one of which is the following: a slip on recoil pad comprising: a cushion; a flexible sleeve extending from the cushion and having an interior surface; and means for accommodating a sling swivel.

The means for accommodating the sling swivel may be an attachment stud mechanism having a post and an eyelet through which a sling swivel can be attached. The means for accommodating a sling swivel is preferably associated with the flexible sleeve which includes an aperture through which an attachment stud mechanism may extend.

The reinforcing means is designed to prevent the means for accommodating the sling swivel from tearing away from the sleeve. The reinforcing means may be, for example, a rivet device, a grommet, or at least one layer of material to prevent marring or scratching of a surface with which the reinforcing means comes into contact. The reinforcing means may be a reinforcing strip that overlies the interior surface of the sleeve.

The present invention may also be summarized as follows: a slip on recoil pad comprising: a cushion; a flexible sleeve extending from the cushion; a sling attachment mechanism attached to the sleeve. The sling attachment mechanism may include a swivel attachment stud.

The sling attachment mechanism may include a post and an eyelet through which a sling swivel can be attached.

It is an object of the present invention to provide a slip on recoil pad having a rifle sling attachment stud.

It is an object of the present invention to provide a slip on recoil pad with a means for enabling the attachment of a rifle sling.

It is an object of the present invention to provide a slip on recoil pad with a rifle sling attachment mechanism with reinforcement to prevent the rifle sling attachment mechanism from pulling through the slip on recoil pad material.

It is an advantage of the present invention to provide a reinforcing material on the inside of a slip on recoil pad having a rifle sling attachment stud extending from the exterior to the interior of the recoil pad so as to prevent inadvertent extraction or pulling through of the rifle sling attachment stud.

It is an object of the present invention to provide a slip on recoil pad having a lined interior surface which overlies the rifle sling attachment stud which extends from the exterior surface of the slip on recoil pad for attachment of a rifle sling.

It is yet another advantage of the present invention to provide a slip on recoil pad having a neoprene lining capable of stretching yet providing a snug fit to the butt stock of the rifle.

It is an object of the present invention to provide a neoprene slip on recoil pad capable of being removed, washed and reinstalled.

It is a further object of the present invention to provide a slip on recoil pad manufactured of a neoprene material for easy application, sturdy installation, and comfort.

DETAILED DESCRIPTION OF THE PREFERRED EMBODIMENT(S)

Figure 1:
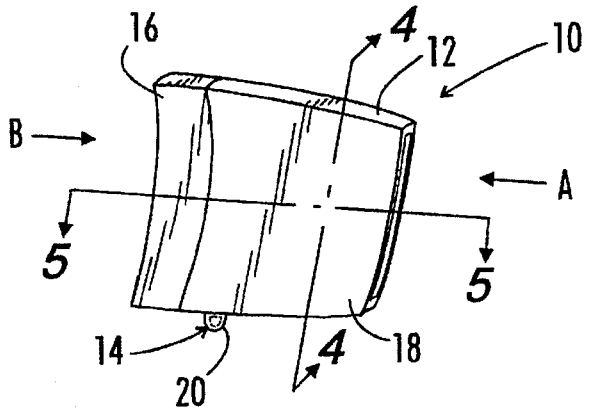
FIG. 1 is side perspective view of an embodiment of the present invention.
Figure 2:
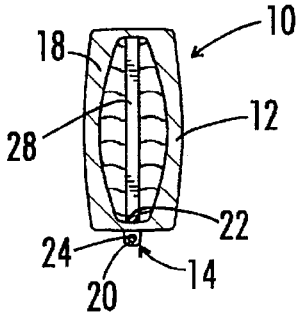
FIG. 2 is an end view of an embodiment of the present invention shown in the direction of arrow A of FIG. 1.
Figure 3:
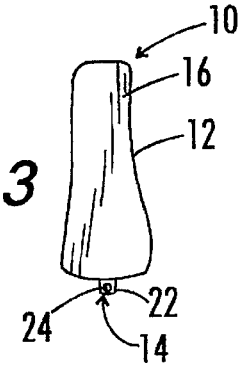
FIG. 3 is an end view of an embodiment of the present invention shown in the direction of arrow B of FIG. 1.
Figure 4:
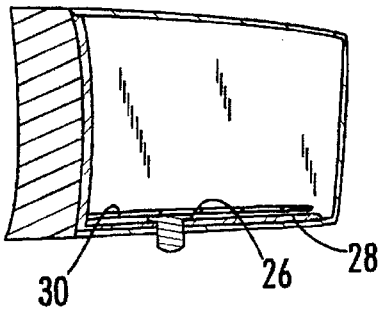
FIG. 4 is a cross sectional view of an embodiment of the recoil pad invention taken along lines 4—4 of FIG. 1.

With reference to FIGS. 1–3, an embodiment of the present invention is designated generally by the reference numeral 10. The embodiment 10 includes a slip on recoil pad component 12, a rifle sling attachment stud or eyelet 14, a cushion section 16, and a sleeve portion 18 extending therefrom. In the preferred embodiment of the present invention, the rifle sling attachment stud 14 includes an eyelet 20 and a post 22. The eyelet includes a rifle sling swivel receiving bore 24 and a rivet or grommet component 26 (see FIG. 4). A reinforcing strip or liner 28 is provided to underline the grommet 26 for additional reinforcement and prevention of the inadvertent extraction of the grommet from the sleeve component 18.

With reference to FIGS. 4 and 5A–C, a protective layer 30 overlies the rivet or grommet 26 to prevent marring or scratching of the rifle stock when the sleeve 18 is slipped over the stock portion of the rifle. In use, the user slips the sleeve portion 18 of the recoil pad 12 over the butt stock (not shown) of a rifle. The protective layer 30 and/or the reinforcing strip or liner 28 prevent scratching or marring of the stock when the recoil pad is installed. Of course it is contemplated that the reinforcing strip may be a rigid stay of a metallic or non-marring material. With respect to a metallic stay, however, it is preferable to include a liner 28 of the type described above to prevent marring of the stock to which the recoil pad invention is applied.

The user then simply attaches a rifle sling swivel (not shown) to the eyelet 20 by inserting a post (not shown) of the rifle sling swivel through the post receiving bore 24 and fastening the swivel in a closed position. The rifle sling swivel can be of any conventionally or commercially available design and such is not critical to the functional operation of the present invention.

Figure 6:
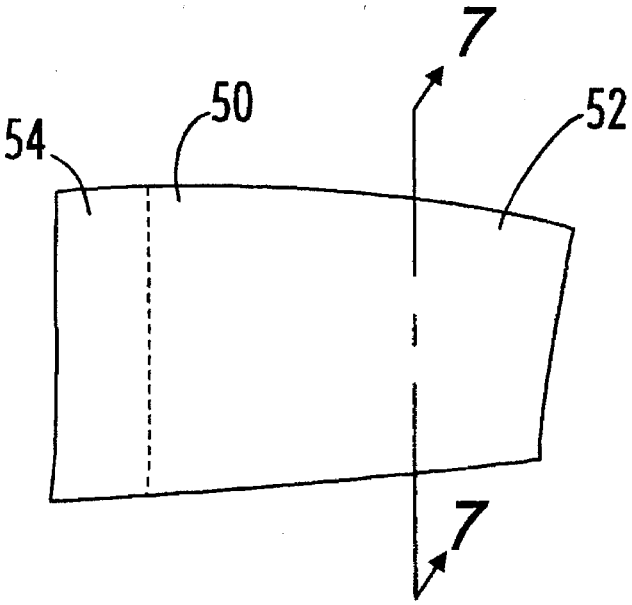
FIG. 6 is a side perspective view of an embodiment of the slip on recoil pad of the present invention.
Figure 7:
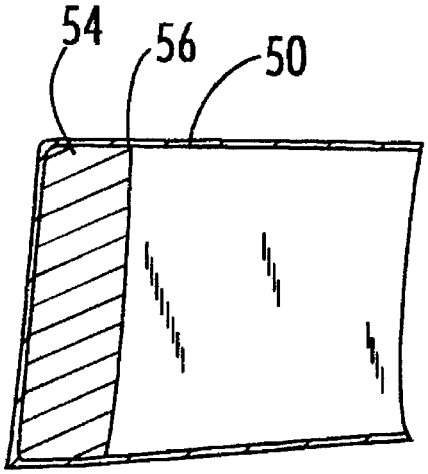
FIG. 7 is a cross sectional view of the recoil pad shown in FIG. 6 taken along lines 7—7 of that Figure.

With reference to FIGS. 6 and 7, a recoil pad 50 is constructed of neoprene. The neoprene recoil pad 50 includes a sleeve portion 52 and a cushion portion 54. In the preferred embodiment, the cushion portion 54 is contained inside the neoprene sleeve 52 and may be formed integral therewith or attached thereto by way of an adhesive between the interface 56 of the sleeve 52 and cushion 54. The neoprene recoil pad is preferred because it provides an inherent layer of protection and cushion to the rifle stock and shooter, a degree of warmth, and variation and ability to have printed inscriptions on the recoil pad for aesthetics, all of which are not found and associated with conventional commercially available recoil pads.

Figure 5A:
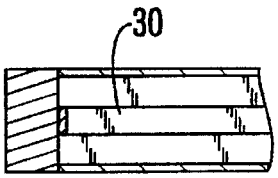
FIGS. 5A–5C is a cross sectional view of various embodiments of the recoil pad of the present invention taken along lines 5—5 of FIG. 1.
Figure 5B:
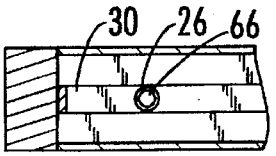
Figure 5C:
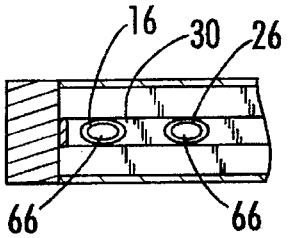
Figure 8:
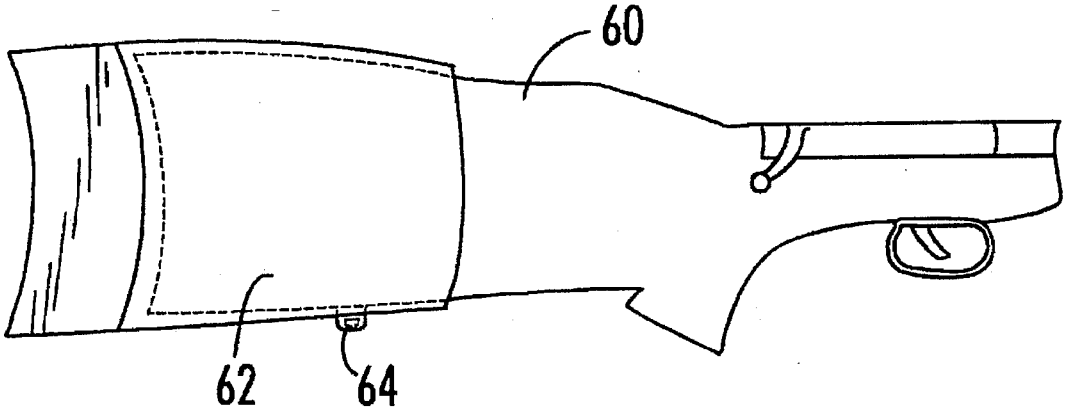
FIG. 8 is a side view of an embodiment of the present invention attached to a rifle stock shown in partial cutaway format.

With reference to FIG. 8, a rifle stock 60 is shown with a recoil pad 62 attached thereto. The sling stud 64 may be attached to the rifle stock in a conventional manner, or it may be part of the recoil pad in the manner described above. If the stud 64 is attached to the stock, the embodiment of the recoil pad shown in FIG. 5B and 5C is preferred, because the grommet 26 of those figures includes an aperture 66 enabling the stud 64 to pass therethrough.

These and other embodiments of the present invention shall become apparent after consideration of the specification and drawings whose only limitation is the scope of the appended claims.

What is claimed is:

1. A slip on recoil pad comprising:

a cushion;

a flexible sleeve extending from the cushion and having an interior surface; and means for accommodating a sling swivel;

the means for accommodating a sling swivel is associated with the flexible sleeve which includes an aperture through which an attachment stud mechanism may extend; and reinforcing means for preventing the means for accommodating the sling swivel from tearing away from the sleeve.

2. The slip on recoil pad of claim 1, wherein:

the means for accommodating the sling swivel is a attachment stud mechanism.

3. The slip on recoil pad of claim 2, wherein the attachment stud mechanism comprises:

a post and an eyelet through which a sling swivel can be attached.

4. The slip on recoil pad of claim 1, wherein:

the reinforcing means is a rivet device.

5. The slip on recoil pad of claim 1, wherein:

the reinforcing means is a grommet.

6. The slip on recoil pad of claim 1, wherein the reinforcing means further includes:

at least one layer of material to prevent marring or scratching of a surface with which the reinforcing means comes into contact.

7. The slip on recoil pad of claim 1, further comprising:

a reinforcing strip that overlies the interior surface of the sleeve.

8. The slip on recoil pad of claim 4, further comprising:

a reinforcing strip that overlies the interior surface of the sleeve.

9. A slip on recoil pad comprising:

a cushion;

a flexible sleeve extending from the cushion;

a sling attachment mechanism attached to the sleeve; and reinforcing means for preventing the sling attachment mechanism from tearing away from the sleeve.

10. The slip on recoil pad of claim 9, wherein:

the sling attachment mechanism is an swivel attachment stud.

11. The slip on recoil pad of claim 10, where the sling attachment mechanism further includes:

a post and an eyelet through which a sling swivel can be attached.

12. The slip on recoil pad of claim 9, wherein the reinforcing means comprises:

a rivet attached to a stud mechanism from the interior of the sleeve.

13. The slip on recoil pad of claim 9, wherein the reinforcing means comprises:

a grommet configuration attached to a stud mechanism from the interior of the sleeve.

14. The slip on recoil pad of claim 9, wherein the reinforcing means comprises:

a layer of material to prevent marring of a surface with which the reinforcing means comes into contact.

15. A slip on recoil pad comprising:

a cushion;

a sleeve extending from the cushion and having an interior;

means for accommodating a sling swivel;

the means for accommodating a sling swivel is associated with the sleeve which includes an aperture; and reinforcing means for preventing the means for accommodating the sling swivel from tearing the sleeve.

16. The slip on recoil pad of claim 15, wherein:

the means for accommodating a sling swivel is a stud mechanism.

17. The slip on recoil pad of claim 15, comprising:

a post having a first end that extends from the interior of the sleeve and a second end with an eyelet through which a sling swivel can be attached.

18. The slip on recoil pad of claim 15, wherein:

the reinforcing means is a rivet device.

19. The slip on recoil pad of claim 15, wherein:

the reinforcing means is a grommet.

20. The slip on recoil pad of claim 15, wherein the reinforcing means further includes:

at least one layer of material to prevent marring or scratching of a surface with which the reinforcing means comes into contact.

* * * * *